US005755009A

United States Patent [19]

Stephens et al.

[11] Patent Number: 5,755,009

[45] Date of Patent: May 26, 1998

[54] BAG MOUNT FOR A VACUUM CLEANER

[75] Inventors: Paul D. Stephens, Cleveland, Heights; Michael F. Wright, Cuyahoga Falls; Charles J. Thur, Broadview Heights, all of Ohio; Mark D. Bosses, Montvalle, N.J.

[73] Assignee: Royal Appliance Mfg. Co., Cleveland, Ohio

[21] Appl. No.: 585,902

[22] Filed: Jan. 16, 1996

[51] Int. Cl.[6] ..... A47L 9/14

[52] U.S. Cl. ..... 15/347; 55/378

[58] Field of Search ..... 15/347, 352; 55/373, 55/378

[56] References Cited

U.S. PATENT DOCUMENTS

| | | | |
|---|---|---|---|
| 2,755,883 | 7/1956 | Brace . | |
| 2,818,936 | 1/1958 | Cropley . | |
| 3,328,942 | 7/1967 | Waters . | |
| 3,417,550 | 12/1968 | Fesco . | |
| 3,491,519 | 1/1970 | Ettridge . | |
| 3,588,944 | 6/1971 | Fromknecht et al. | 15/347 X |
| 3,675,399 | 7/1972 | Westergren | 55/378 X |
| 3,683,599 | 8/1972 | Malz . | |
| 4,322,231 | 3/1982 | Hilzendeger et al. | 55/378 X |
| 4,591,369 | 5/1986 | Stewart, Sr. et al. . | |
| 4,705,547 | 11/1987 | Rotola et al. | 55/378 X |
| 4,748,713 | 6/1988 | Sepke et al. . | |
| 4,885,013 | 12/1989 | Ahlf et al. . | |
| 5,028,245 | 7/1991 | Stein et al. . | |
| 5,089,038 | 2/1992 | Kopco et al. . | |
| 5,092,915 | 3/1992 | Lackner . | |
| 5,544,385 | 8/1996 | Jailor et al. | 55/378 X |

*Primary Examiner*—Chris K. Moore

[57] ABSTRACT

A vacuum cleaner includes a housing having a nozzle and a selectively removable cover having an inner surface and an outer surface. A filter chamber is defined in the housing when the cover is in place. A bag mounting structure is located on the inner surface of the cover. The bag mounting structure includes a mounting plate secured to the cover inner surface and a first mounting rail located on the mounting plate for guiding an edge of the mounting collar of an associated filter bag. A locking finger is mounted on the mounting plate. The locking finger cooperates with another edge of the mounting collar of the associated filter bag in order to secure the filter bag to the bag mounting structure. When the bag is correctly mounted on the cover, the cover can be attached to the housing of the vacuum cleaner thereby enabling the vacuum cleaner to be used.

23 Claims, 5 Drawing Sheets

BAG MOUNT FOR A VACUUM CLEANER

BACKGROUND OF THE INVENTION

This invention relates generally to vacuum cleaners. More particularly, the present invention concerns a vacuum cleaner having a removable dirt collection filter bag carried within a housing portion of the vacuum cleaner.

In canister vacuum cleaners, a dirt collecting filter bag is removably mounted within a canister housing of the vacuum cleaner. The canister housing conventionally includes a base and a hood movably associated with the base to provide access to a dirt chamber—defined between the base and hood—in which the filter bag is mounted. There are also upright vacuum cleaners utilizing a hard box housing which have a sealed dirt chamber containing a disposable filter bag. The hard box type upright vacuum cleaner is essentially a canister type cleaner since the disposable bag is located upstream of the suction fan so that dirt is sucked into the bag rather than being propelled into the bag by a fan.

In practice, the process of changing a disposable gfilter bag is frequently rather difficult and complicated. It is often a problem for a person to correctly secure an empty disposable filter bag's mouth to the air inlet of the vacuum cleaner. The result is that filter bags are frequently incorrectly installed and the dust picked up by the vacuum cleaner is not deposited as intended in the filter bag, but is scattered throughout the filter chamber, or is expelled with the air blown out of the vacuum cleaner, and back into the room which is meant to be cleaned. Since hard box upright vacuum cleaners are equipped with so-called flow through motors, the dirt not trapped by the filter bag in the filter chamber is pulled into the motor where it can cause significant damage.

Also, it is sometimes difficult to detach a full bag from the bag mount assembly without spilling the bag's contents. When the bag is detached, it needs to be carried to a trash container for disposal. This act provides another opportunity for dirt to be spilled from the bag.

Accordingly, it has been considered desirable to develop a new and improved vacuum cleaner bag mount assembly which would overcome the foregoing difficulties and others while providing better and more advantageous overall results.

BRIEF SUMMARY OF THE INVENTION

In accordance with one aspect of the present invention, a new and improved vacuum cleaner is provided.

More particularly in accordance with this aspect of the invention, the vacuum cleaner comprises a housing including a nozzle and a selectively removable cover having an inner surface and an outer surface. A filter chamber is defined in the housing when the cover is in place. A bag mounting structure is located on the inner surface of the cover. The bag mounting structure comprises a mounting plate secured to the cover inner surface and a first mounting rail located on the mounting plate for guiding an edge of a mounting collar of an associated filter bag. A locking finger is secured to the mounting plate. The locking finger cooperates with another edge of the mounting collar of the associated filter bag for securing the filter bag to the bag mounting structure.

Preferably, a hinge is provided for mounting the locking finger to the mounting plate. Preferably also, a biasing element is mounted on the mounting plate for biasing the locking finger to one end position. A second mounting rail may be located on the mounting plate in a spaced manner from the first mounting rail for guiding another edge of the mounting collar of the associated filter bag. Preferably the first and second mounting rails extend at an acute angle toward each other and the bag mounting plate of the associated filter bag is substantially trapezoidally shaped.

The mounting plate can be rigidly secured to the cover inner surface. Alternatively, the mounting plate can be pivotally secured to the cover inner surface. If the mounting plate is pivotally secured, a biasing means can be provided to bias the mounting plate to one end position in relation to the cover inner surface. Preferably the vacuum cleaner further comprises an air suction means located in the housing, a conduit communicating at a first end with the nozzle base and at a second end with the filter chamber and the conduit second end extending into an opening in the mounting collar of the associated filter bag when the associated filter bag is located in the bag mounting structure and the cover is secured to the housing.

One advantage of the present invention is the provision of a new and improved vacuum cleaner.

Another advantage of the present invention is the provision of a vacuum cleaner having a bag mounting structure which is located on an inner surface of a removable cover of a housing of the vacuum cleaner.

Still another advantage of the present invention is the provision of a bag mounting structure having a locking finger which cooperates with a mounting collar of an associated filter bag in order to secure the filter bag to the bag mounting structure.

Yet another advantage of the present invention is the provision of a trapezoidally shaped mounting collar for a filter bag. The collar includes a central portion which is adhered to the filter bag and a peripheral portion which is not adhered. The peripheral portion cooperates with one or more rails of a bag mounting structure. A portion of one edge of the mounting collar cooperates with a locking finger of the bag mounting structure in order to secure the filter bag in place in a housing of the vacuum cleaner.

A further advantage of the present invention is the provision of a vacuum cleaner bag mount structure including a pair of spaced mounting rails located on a mounting plate, a locking finger pivotally secured to the mounting plate and a biasing element secured to the mounting plate for biasing the locking finger to one end position.

A yet further advantage of the present invention is the provision of a filter bag mounting structure for a vacuum cleaner wherein a mounting plate, a locking finger and a biasing element are of one piece and made of a suitable resilient thermoplastic material so that the locking finger is connected by a living hinge to the mounting plate and the biasing element protrudes from the mounting plate toward one end of the locking finger in order to bias the locking finger to one end position in relation to the mounting plate.

Still other benefits and advantages of the invention will become apparent to those of average skill in the art upon a reading and understanding of the following detailed specification.

BRIEF DESCRIPTION OF THE DRAWINGS

The invention may take physical form in certain parts and arrangements of parts preferred embodiments of which will be described in detail in this specification and illustrated in the accompanying drawings which form a part hereof and wherein.

DESCRIPTION OF THE PREFERRED EMBODIMENTS

Figure 1:
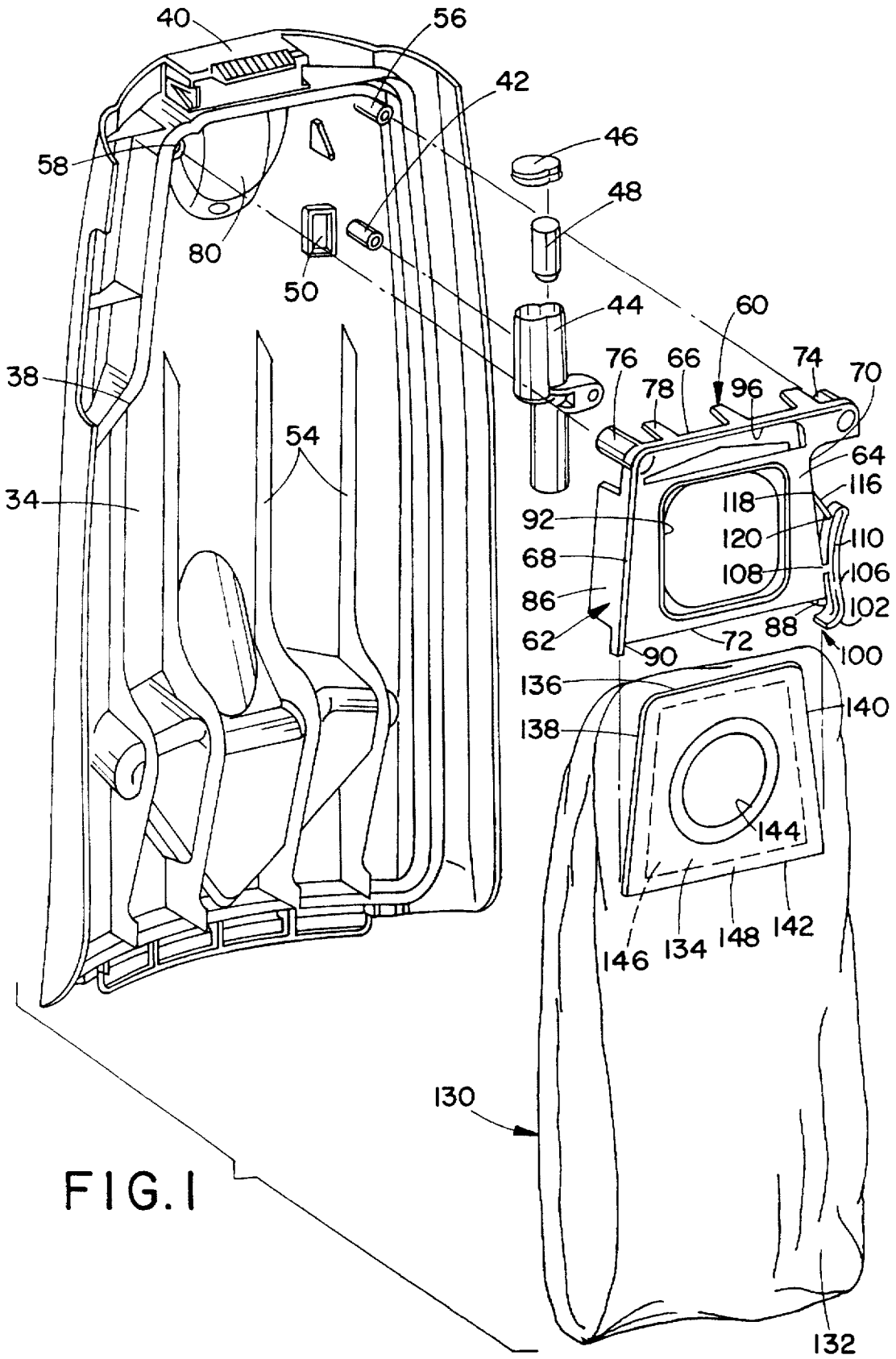
FIG. 1 is an exploded perspective view of a removable cover for a housing of a vacuum cleaner, a bag full indicator and a bag mounting structure, together with a filter bag according to a first preferred embodiment of the present invention.
Figure 3:
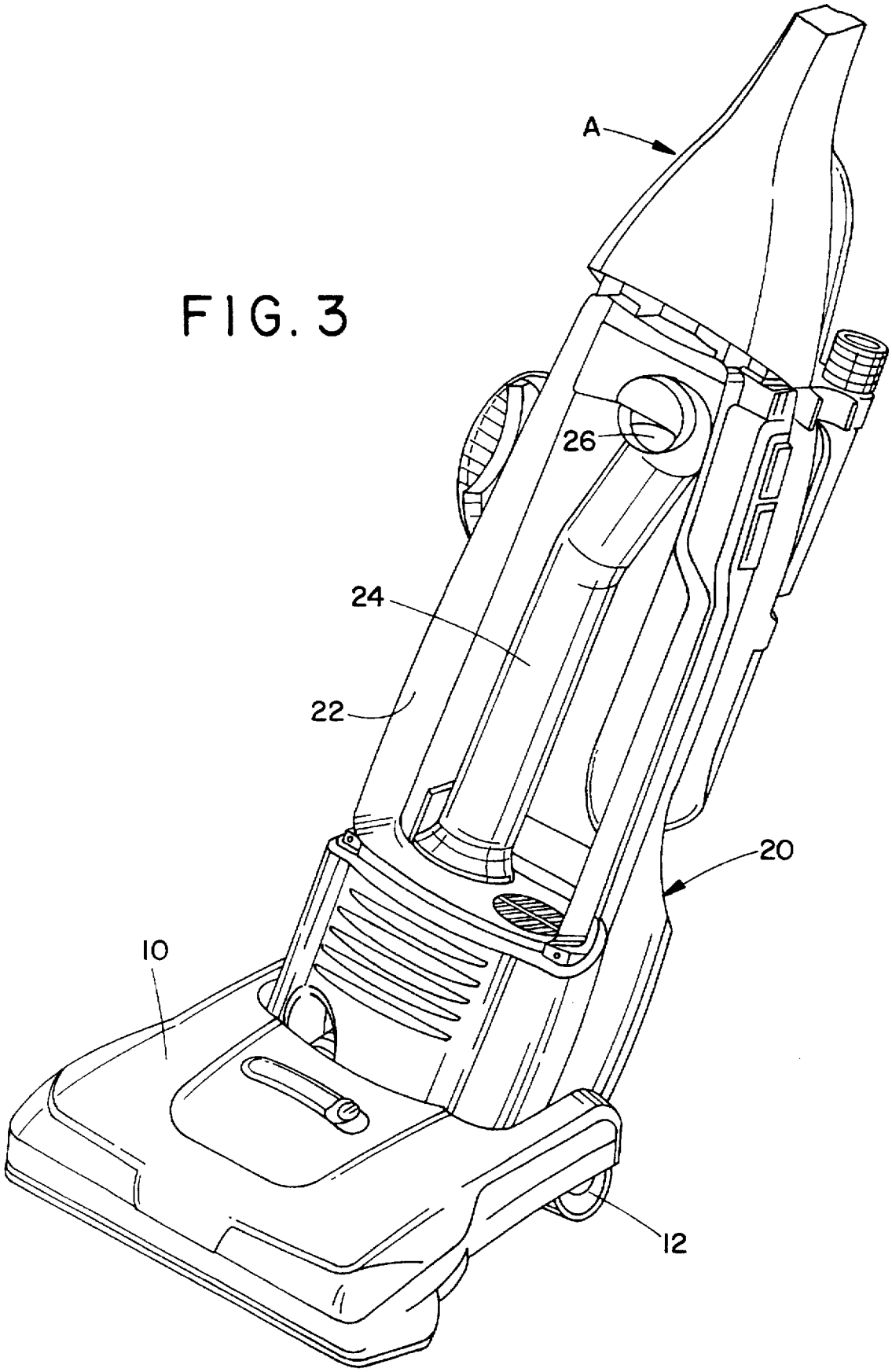
FIG. 3 is a perspective view of the vacuum cleaner according to the present invention to which the cover of FIG. 2 can be selectively secured.

Referring now to the drawings wherein the showings are for purposes of illustrating preferred embodiments of the invention and not for purposes of limiting same, FIG. 1 shows a first preferred embodiment of a bag mount assembly for a cover of a vacuum cleaner A that is illustrated in FIG. 3. While the bag mount assembly is primarily designed for and will hereinafter be described in connection with a particular type of vacuum cleaner, namely a hard box upright vacuum cleaner, it should be appreciated that the overall inventive concept involved could be adapted for use in other types of upright vacuum cleaners as well as canister vacuum cleaners and many other cleaning or filtration environments as well.

With reference first to FIG. 3, the vacuum cleaner A includes a nozzle base 10 which can be rotatably supported, as by wheels 12, from a subjacent floor surface (not illustrated). Pivotally secured to the nozzle base 10 is a main body housing 20. The housing 20 includes a filter chamber 22 into which extends a dirty air conduit 24 having an outlet end 26. An air suction means (not visible) is located in the housing 20 beneath the filter chamber 22.

Figure 2:
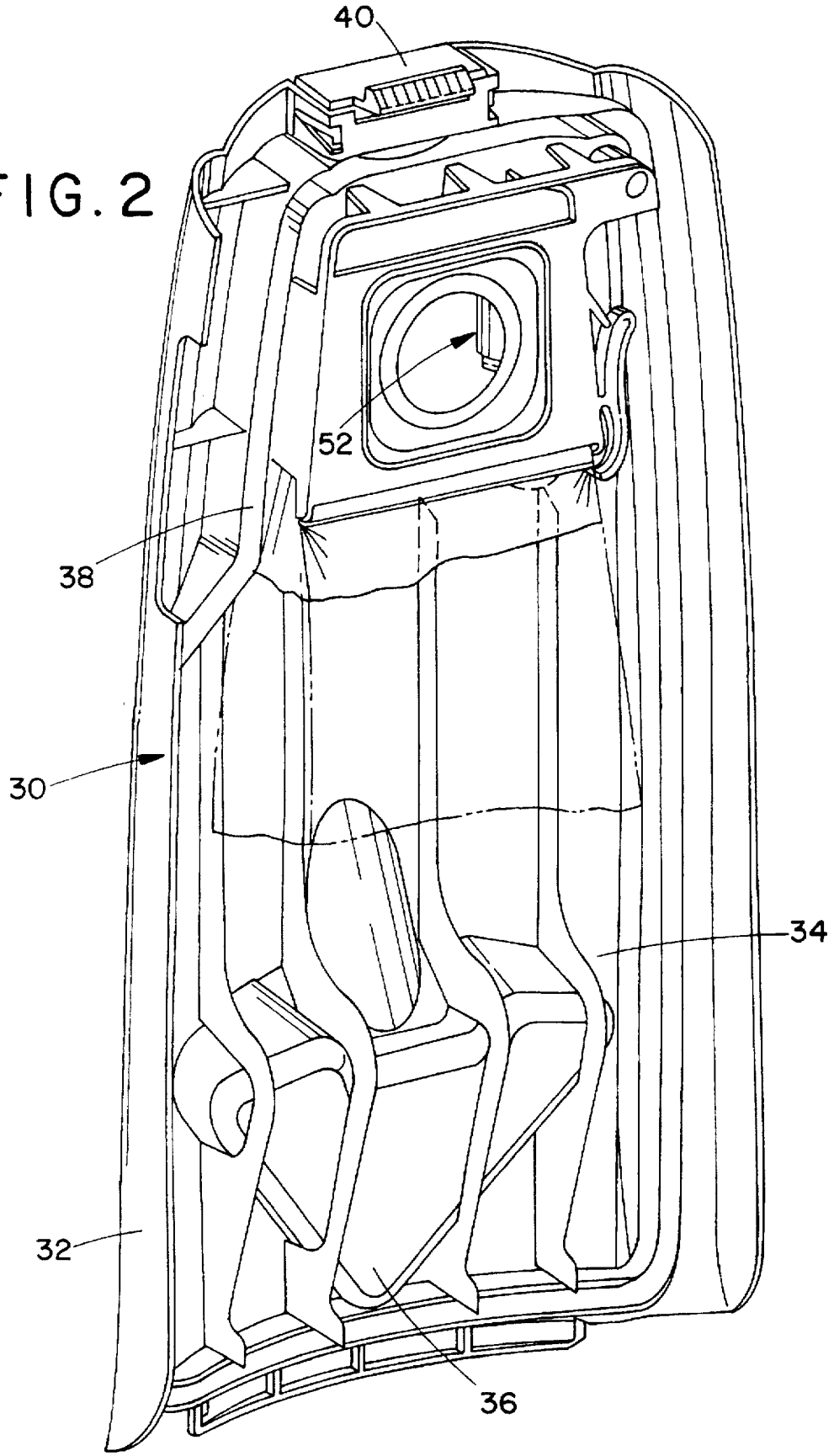
FIG. 2 is an enlarged assembled view of the cover of FIG. 1.

With reference now to FIG. 2, a cover 30 can be selectively secured on the housing 20 to enclose the filter chamber 22. The cover includes an outer surface 32 and an inner surface 34. Noticeable on the inner surface is an indentation 36 for a triangular nozzle tool (not visible) which can be employed when the vacuum cleaner is used in its auxiliary cleaning mode. A channel 38 extends around the inner surface 34 for accommodating a seal (not visible) for sealingly mounting the cover 30 on the housing 20. Located on the cover at the upper end thereof is a latch mechanism 40.

With reference now to FIG. 1, protruding from the cover inner surface 34 is a first stem 42. Selectively secured to the first stem is a full bag indicator housing 44. The indicator is a substantially cylindrical hollow element including a cap 46 for closing an upper end of the housing. A movable indicator member 48 is reciprocated in the indicator housing 44. The indicator is visible through a window 50 located in the cover 30. Together, these elements define a full bag indicator 52 (FIG. 2). Extending longitudinally along the cover inner surface 34 are a plurality of spaced ribs 54. The ribs serve to space the vacuum cleaner bag supported on the cover 30 away from the cover inner surface 34 to provide an air flow path.

Figure 4:
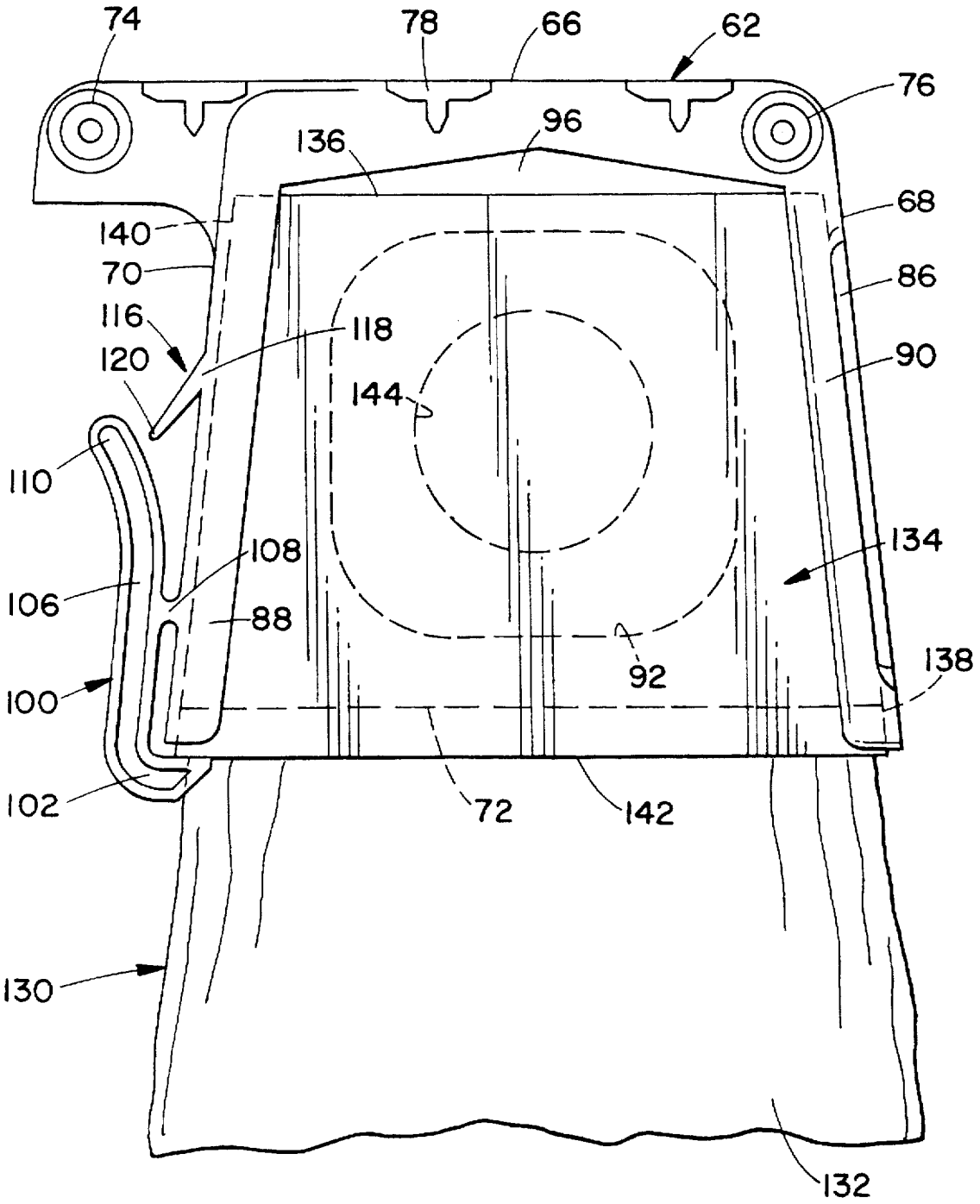
FIG. 4 is an enlarged bottom plan view of the bag mounting structure of FIG. 1 with a bag being held therein.

Also protruding from the inner surface of the cover is a second stem 56 and, spaced therefrom, a third stem 58. These two stems are located near the upper end of the cover. The two stems are used for mounting a bag holder 60. With reference now also to FIG. 4, the bag holder or bag mounting structure comprises a housing or mounting plate 62 having a front wall 64 with a top edge 66, first and second side edges 68 and 70 and a bottom edge 72. Extending away from opposite corners of the top edge 66 are first and second sleeves 74 and 76. The sleeves are so sized and spaced as to slide over the second and third stems 56 and 58 when the housing 62 is mounted on the cover 30. Such mounting can be via suitable conventional fasteners (not illustrated) extending through the sleeves 74 and 76 and into the stems 56 and 58. Protruding from the top edge 66 between the first and second sleeves 74 and 76 are a plurality of fingers 78. It should be appreciated that the fingers 78 can, if desired, be shorter in length than the sleeves 74 and 76 since the fingers 78 will be contacting a raised portion 80 on the cover inner surface 34. A side wall 86 projects approximately perpendicularly from the first side edge 68 of the front wall 64. The side wall, the sleeves and the fingers serve to rigidly mount the housing 62 on the cover inner surface 34.

Extending along the first and second side edges 68 and 70 are respective first and second mounting rails or channels 90 and 88, as best shown in FIG. 4. A first aperture 92 which can be substantially square in shape, if desired, is located in the front wall 64. Spaced therefrom is a second aperture 96 in the front wall.

The bag holder 60 further comprises a locking member or locking finger 100. The locking member has a bent first end 102 and a straight central portion 106 at which a living hinge 108 connects the locking member to the housing 62, adjacent the second edge 70 of the front plate 64. Further, the locking member includes an angled second end 110. As can be seen from FIG. 4, the locking member is shaped somewhat like a reverse L so that the bent first end 102 thereof extends approximately normal to the central portion 106 thereof and the second end 110 is disposed at an acute angle in relation to the central portion.

Further provided on the bag holder 60 is a biasing means 116 which can be in the form of a biasing element, such as a finger. The biasing means includes a base end 118 at which it is secured to the housing 62, adjacent the second edge 70 of the front plate 64 and in a spaced manner from the living hinge 108. A tip 120 of the biasing means 116 can selectively contact the second end 110 of the locking member 100 in order to bias same to a first end position in its pivoting movement around the living hinge 108. That end position swings the locking member first end 102 beneath the bottom edge 72 of the housing front wall 64.

A filter bag 130 is intended to be held by the bag holder 60. The filter bag comprises a plurality of walls 132 made of a porous material, such as paper, and a hard card or mounting collar 134 used for mounting the bag. The hard card includes a top edge 136, first and second side edges 138 and 140 and a bottom edge 142. An aperture 144 extends through the hard card and communicates with an interior of the filter bag 130. The hard card is secured to the wall 132 of the filter bag via a glued area 146. It should be appreciated that the glued area is smaller in dimension than is the area of the hard card so as to leave an unglued edge portion 148 around the periphery of the hard card. The unglued edge portion on the two sides 138 and 140 of the hard card is then employed when the hard card is slid into the two channels 88 and 90 of the housing 62.

It should be appreciated that both the hard card and the housing front wall 64 are approximately trapezoidal in shape such that the respective top edges 66—of the front wall 64—and 136—of the hard card 134—are smaller in length than are the respective bottom edges 72 and 142 thereof. The two respective side edges 68 and 70 of the front wall and 138 and 140 of the hard card diverge from each other when extending from their respective top edge 66, 136 to their respective bottom edge 72, 142.

The hard card 134 of the filter bag 130 can be slid into the housing 62 of the bag holder 60 when the locking member 100 is pivoted out of the way. To accomplish this task, the user pushes the locking member second end 110 toward the front wall second edge 70, against the urging of the biasing means 116 thereby pushing the tip 120 of the biasing means down against the front wall second edge. Such movement of the locking member second end 110 pivots the first end 102 of the locking member out from beneath the bottom edge 72 of the front wall 64. This enables the unglued edge portions 148 of the hard card 134 to be slid into the opposed channels 88 and 90 of the housing 62. Thereafter, the user can let go of the locking member second end. At this point, the free end 120 of the biasing means 116 will push the locking member second end 110 away from the second side edge 70 of the housing 62 thereby pivoting the locking member 100 around the living hinge 108 such that the first end 102 thereof can extend beneath the front wall bottom edge 72. The first end 102 of the locking member will contact the bottom edge 142 of the hard card 134 in order to secure the hard card in place. The locking finger 100 prevents gravity from sliding the hard card 134 out of the bag holder 60.

Once a filter bag has been installed on the cover 30, the cover can then be mounted on the housing 20. As the cover is latched into place on the housing 20, via the latch mechanism 40, the outlet end 26 of the dirty air conduit 24 will protrude into the aperture 144 of the filter bag 130 in order to ready the vacuum cleaner A for use. It should be apparent from FIG. 2 that the card aperture 144 is accessible to the dirty air conduit outlet end 26 as it is framed by the first aperture 92 of the bag holder front wall 64.

Once the filter bag 130 is filled, as will be indicated by the full bag indicator 52, the cover 30 can be removed from the housing 20. Advantageously, the entire cover can be taken over to a wastebasket and then the full filter bag 130 can be removed from the cover 30. In order to do this, the user pushes on the second end 110 of the locking member 100 in order to pivot its first end 102 out from beneath the front wall bottom edge 72. Then the hard card 134 can be slid out of the housing 62 and the filter bag can be discarded. A new filter bag can then be employed to replace the discarded one.

The housing 62 is preferably molded from a suitable conventional thermoplastic material, such as acetal. Acetal has been found advantageous in that it allows the living hinge 108 and the biasing means 116 to flex as needed in pivoting the locking member 100 in relation to the front wall 64. The purpose of the second aperture 96 in the bag holder front wall 64 is to aid in the molding operation for the housing.

Figure 5:
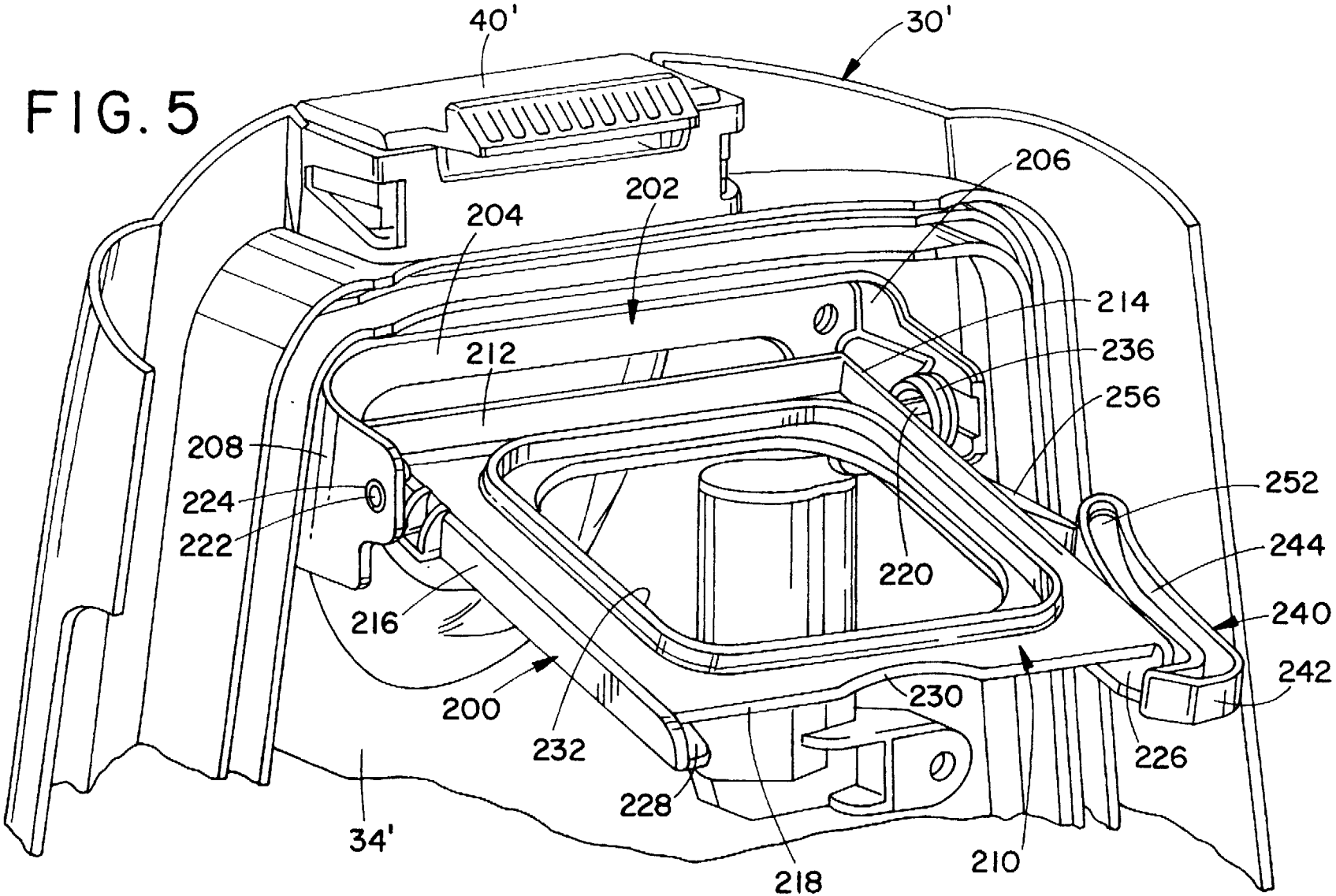
FIG. 5 is an enlarged perspective view of a bag mounting structure according to a second preferred embodiment of the present invention.

With reference now to FIG. 5, a second preferred embodiment of the invention is there illustrated. For ease of appreciation of this embodiment, like components are identified by like numerals with a primed (') suffix and new components are identified by new numerals.

FIG. 5 illustrates a bag holder or bag mounting structure 200 secured to an inner surface 34' of a cover 30' directly beneath a latch mechanism 40' of the cover. The bag holder 200 comprises a base 202 which includes a back wall 204 and a pair of spaced side walls 206 and 208 which extend approximately normal to the back wall. Mounted on the base 202 is a bag plate 210. The plate includes a top edge 212, a pair of opposed side edges 214 and 216 and a bottom edge 218. Protruding away from the opposed side edges 214 and 216 are a pair of stems 220 and 222. The stems extend through respective apertures 224 (only one of which can be seen in FIG. 5) in the side walls 206 and 208 to pivotally mount the back plate 210 in the base 202. Extending along the opposed side edges 214 and 216 of the back plate 210 are first and second rails 226 and 228. Located along the bottom edge 218 of the bag plate 210 is a recess 230. Extending through the bag plate 210 is a first substantially square aperture 232.

The bag plate 210, as mentioned, is pivotally mounted on the base 202. In order to urge the bag plate 210 into one end position in relation to the base 202, a second biasing means or biasing member in the form of a torsion spring 236 can be mounted on the first stem 220. The spring 236 urges the bag plate 210 into an orientation which is approximately normal to the plane of the cover 30'. In this condition, when a filter bag is not housed in the bag holder 200, the cover could not be readily secured on the housing as the bag plate 210 would contact the outlet end of the dirty air conduit in the filter chamber illustrated in FIG. 3. However, when an empty bag (not illustrated in FIG. 5) is slid into the bag plate 210, the mere weight of the bag is sufficient to overcome the biasing force of the spring 236 and allow the bag plate 210 to rotate in a clockwise direction in FIG. 5, i.e. down, so that it assumes an orientation which is substantially parallel to the plane of the cover 30'.

In order to secure the hard card of the filter bag in place in the bag holder 200, a locking member 240 is located on the bag plate 210. The locking member includes a bent first end 242, a straight central portion 244 connected by a living hinge (not visible) to the bag plate 210, and an angled second end 252. Also provided is a biasing means or element 256 having a tip which urges the second end 252 of the locking member 240 away from the bag plate second side edge 216. This action pivots the locking member first end 242 beneath the bag plate bottom edge 218 to hold the hard card in the bag plate.

The invention has been described with reference to preferred embodiments. Obviously, modifications and alterations will occur to others upon a reading and understanding of this specification. It is intended to include all such modifications and alterations insofar as they come within the scope of the appended claims or the equivalents thereof.

What is claimed is:

1. A vacuum cleaner comprising:

a housing including a nozzle and a selectively removable cover having an inner surface and an outer surface;

a filter chamber defined in said housing when said cover is in place;

a bag mounting structure located on said inner surface of said cover, said bag mounting structure comprising:

a mounting plate secured to said cover inner surface, a first mounting rail located on said mounting plate for holding an edge of a mounting collar of an associated filter bag, and a locking finger located on said mounting plate, said locking finger cooperating with another edge of a mounting collar of the associated filter bag for securing the filter bag to said bag mounting structure.

2. The vacuum cleaner of claim 1 further comprising a hinge for mounting said locking finger to said mounting plate.

3. The vacuum cleaner of claim 2 further comprising a biasing element located on said mounting plate for biasing said locking finger to one end position.

4. The vacuum cleaner of claim 1 further comprising a second mounting rail located on said mounting plate in a spaced manner from said first mounting rail wherein said first and second mounting rails guide a sliding movement of opposed edges of the mounting collar of the associated filter bag.

5. The vacuum cleaner of claim 4 wherein said first and second mounting rails extend at an acute angle towards each other and the mounting collar of the associated filter bag is substantially trapezoidally shaped.

6. The vacuum cleaner of claim 1 wherein said mounting plate is rigidly secured to said cover inner surface.

7. The vacuum cleaner of claim 1 wherein said mounting plate is pivotally secured to said cover inner surface.

8. The vacuum cleaner of claim 7 further comprising a biasing member located on said bag mounting structure and cooperating with said mounting plate for pivoting said mounting plate to one end position in relation to said cover inner surface.

9. The vacuum cleaner of claim 1 further comprising:

an air suction means located in said housing;

a conduit communicating at a first end with said nozzle base and at a second end with said filter chamber; and, said conduit second end extending into an opening in the mounting collar of the associated filter bag when the associated filter bag is located in said bag mounting structure and said cover is secured to said housing.

10. A filter bag mount for a vacuum cleaner, comprising:

a removable cover for a housing of the vacuum cleaner, said cover having an outer surface and an inner surface; and, a bag mounting structure located on said inner surface of said cover, said bag mounting structure comprising:

a mounting plate secured to said cover inner surface, a first mounting rail located on said mounting plate for holding a first side edge of a mounting collar of an associated filter bag, and a locking finger located on said mounting plate, said locking finger cooperating with a base edge of a mounting collar of the associated filter bag for securing the filter bag to said bag mounting structure.

11. The bag mount of claim 10 further comprising a hinge for mounting said locking finger to said mounting plate.

12. The bag mount of claim 11 further comprising a biasing element mounted on said mounting plate for biasing said locking finger to one end position.

13. The bag mount of claim 12 wherein said mounting plate, said locking finger and said biasing element are of one piece and comprise a resilient thermoplastic material.

14. The bag mount of claim 10 further comprising a second mounting rail located on said mounting plate in a spaced manner from said first mounting rail, wherein said first and second mounting rails guide a sliding movement of opposed side edges of the mounting collar of the associated filter bag.

15. The bag mount of claim 14 wherein said first and second mounting rails extend at an acute angle towards each other and the mounting collar of the associated filter bag is substantially trapezoidally shaped.

16. The bag mount of claim 10 wherein said mounting plate is rigidly secured to said cover inner surface.

17. A vacuum cleaner filter bag mount, comprising:

a filter bag comprising a trapezoidally shaped mounting collar with first and second side edges extending at an acute angle with respect to each other and a base edge;

a bag mounting structure located on one of an inner surface of a cover of the vacuum cleaner and a housing of the vacuum cleaner, said bag mounting structure comprising:

a mounting plate secured to said one of said cover inner surface a first mounting, a first mounting rail located on said mounting plate for guiding a sliding movement of said first side edge of said mounting collar, a second mounting rail located on said mounting plate in a spaced manner from said first mounting rail for guiding a sliding movement of said second side edge of said mounting collar, wherein said first and second rails extend at an acute angle in relation to each other, and a locking finger mounted on said mounting plate, said locking finger cooperating with said base edge of said mounting collar for securing said filter bag to said bag mounting structure.

18. The bag mount of claim 17 further comprising a hinge for mounting said locking finger to said mounting plate.

19. The bag mount of claim 18 further comprising a biasing element mounted on said mounting plate in a spaced manner from said hinge for biasing said locking finger to one end position.

20. The bag mount of claim 19 wherein said mounting plate, said locking finger and said biasing element are of one piece and comprise a resilient thermoplastic material.

21. The bag mount of claim 17 wherein said filter bag further comprises:

an enclosing wall;

an adhesive covered area securing said mounting collar to said enclosing wall; and, an adhesive-free area encircling said adhesive covered area so that said side edges and said bottom edge of said mounting collar lie in said adhesive-free area.

22. The bag mount of claim 17 wherein said filter bag further comprises a flexible wall secured to said mounting collar and wherein said collar comprises a planar layer of relatively stiff material.

23. The bag mount of claim 22 wherein said flexible wall extends past a side edge of said mounting collar in all directions.

* * * * *